United States Patent [19]

Glover

[11] 4,161,443

[45] Jul. 17, 1979

[54] POTATO AND ROCK SORTER

[76] Inventor: Tony L. Glover, R.R. 1, Tigerton, Wis. 54486

[21] Appl. No.: 902,090

[22] Filed: May 2, 1978

[51] Int. Cl.[2] ..... B03B 5/66

[52] U.S. Cl. ..... 209/157

[58] Field of Search ..... 209/155–159, 209/173, 18

[56] References Cited

U.S. PATENT DOCUMENTS

| | | | |
|---|---|---|---|
| 2,151,007 | 3/1939 | Belknap | 209/173 |
| 2,369,863 | 2/1945 | Sevey | 209/156 X |
| 2,626,051 | 1/1953 | Innes et al. | 209/158 X |
| 2,698,087 | 12/1954 | Call et al. | 209/158 |
| 3,683,945 | 8/1972 | Weisser | 209/173 X |

*Primary Examiner*—Ralph J. Hill

*Attorney, Agent, or Firm*—Clarence A. O'Brien; Harvey B. Jacobson

[57] ABSTRACT

An apparatus for the separation of objects of dissimilar specific gravity from a mixture, the invention comprises a water bath into which the mixture is charged through a chute and caused to move over an opening in an inclined baffle member. As the objects move over the opening a stream of water under pressure is directed against the objects to cause lighter objects to be deflected past the opening to a first conveyor for removal from the water bath, heavier objects falling through the opening to a second conveyor for discharge from the water bath. The present apparatus is particularly useful for sorting potatoes from rocks after harvest of the potatoes.

3 Claims, 3 Drawing Figures

10
12
16
18
20
24
26
28
29
30
32
40
41
42
43
44
45
46
52
54
60
62
68
2
3

10
62
64
60
66
52
50
18
48
46
58
12
14
68
56
14

10

30
32
42
43
41
12
40
29
34
23
24
27
25
22
26
36
16
38
14
44
68

POTATO AND ROCK SORTER

BACKGROUND OF THE INVENTION

1. Field of the Invention

In general, the present invention relates to apparatus for separating from a mixture objects having a relatively low specific gravity from objects having a relatively high specific gravity, the objects within the mixture being heavier than water. The invention particularly relates to an immersion sorting apparatus useful for washing harvested potatoes and for removing rocks, debris, and adhering materials from the potatoes.

2. Description of the Prior Art

Due to the nature of the environment in which the useful portion of a potato plant naturally grows, potatoes, rocks, soil and debris are inevitably mixed during harvest. It is therefore necessary to remove the rocks and debris from the potatoes before the potatoes can be graded or processed. Since operationally effective and economically feasible sorting apparatus have not previously been available, rocks and debris are generally removed, particularly in the relatively smaller potato harvesting operations, by manual sorting operations. As is apparent, such manual operations are expensive and time consuming. While rocks and other debris can be separated from potatoes at a processing plant it is desirable to separate the potatoes from the associated debris prior to transport of the potatoes to the processing plant in order to limit damage to the potatoes while in transport. Therefore, it is desirable to effect sorting and washing operations as near to the harvesting operation as is possible. Therefore, the rocks and debris associated with and mixed with harvested potatoes must be removed in an economical manner as soon as is practical after harvesting in order to prevent damage to the potatoes during transport and to allow for immediate processing of the potatoes on arrival at a processing plant, it being an absolute necessity to remove rocks and similar debris from the potatoes before processing in order that processing equipment not be damaged.

Schoeneck, in U.S. Pat. No. 2,990,064, discloses an apparatus for washing potatoes and sorting the potatoes from rocks and other debris. In the Schoeneck apparatus, a flow of water caused to move downwardly along an inclined plane in a wash tank moves the lighter potatoes faster and thus further within the wash tank than the heavier rocks are caused to be moved, the potatoes thereby being separated from the rocks and removed from the wash tank at a location downstream of the flow of water. Lapeyre, in U.S. Pat. No. 3,421,620, discloses an apparatus for separating an undesired heavier component of a mixture of materials from a lighter desired component by placing the mixture in a liquid bath, the mixture being first lifted and then moved over a trap whereby the heavier of the two components settles out of the mixture into the trap by gravitation, the lighter component passing over the trap and thereby being separated from the heavier component. While the devices of the prior art as represented by Schoeneck and Lapeyre have found utility in the art, the present apparatus provides a mechanically compact, economically advantageous apparatus particularly intended for removal of rock and associated debris from harvested potatoes, a stream of water being directed against the mixture of potatoes and rock in a water bath as the mixture is caused to move over an opening formed in an inclined baffle member, the lighter potatoes being deflected past the opening to a first conveyor for removal from the water bath. The heavier rocks fall through the opening to a second conveyor for discharge from the bath.

SUMMARY OF THE INVENTION

The present invention provides apparatus which is particularly useful for separating potatoes from rocks and associated debris which accumulates with the potatoes during normal harvesting operations. The present apparatus can be seen to be mechanically compact, that is, it does not require a lengthy flowing water tank within which potatoes and rock separate by gravity at differing rates depending on the flow rate of the water, such as is commonly employed in the prior separation of potatoes from rock. The present apparatus comprises a compact water tank having a loading chute disposed at a location on the upper periphery of the tank, the chute extending into the water to direct a mixture of potatoes and rock charged into the chute onto an inclined baffle member which extends toward the center of the water tank. The inclined baffle member has an opening disposed therein over which the mixture of potatoes and rock are caused to pass. Apparatus for directing a stream of water under pressure is disposed immediately beneath a leading perimetric edge of the opening in the baffle member, the apparatus producing a stream of water under pressure and directing the stream of water through the opening at an angle to the plane of the baffle member. When the stream of water strikes the potatoes and rock passing over the opening in the baffle member, the lighter in weight potatoes are deflected upwardly past the opening in the baffle member and continue to move downwardly over and along lower portions of the baffle member to a conveyor which receives the potatoes and removes said potatoes from the water bath. The heavier rocks are insufficiently deflected by the stream of water to prevent the rocks from falling through the opening in the baffle member, the rocks passing through the opening falling onto a separate conveyor which acts to remove the rocks from the water bath. Pumping apparatus preferably withdraws water from the water tank and discharges the water through the aforesaid apparatus through the opening in the baffle plate member, the water being discharged under pressure to form a stream of water as aforesaid. The potatoes are also washed to remove adhering debris during this sorting operation, the potatoes exiting the water bath being in a condition suitable for grading or other processing operations.

It is therefore an object of the present invention to provide improved apparatus for separating potatoes from material with which the potatoes become associated during harvesting, such as rock, soil, and other debris.

It is another object of the invention to provide inexpensive and mechanically compact apparatus for separating potatoes from rock and other debris, the apparatus being sufficiently inexpensive and operationally effective in order that the potatoes can be sorted from the rock and debris in the field near the point of harvest, thereby to minimize damage to the potatoes caused by transport of the potatoes with rock and similar debris.

It is a further object of the invention to provide improved apparatus capable not only of sorting potatoes from rock and similar debris but also capable of effecting a wash of the potatoes.

It is a still further object of the invention to provide improved apparatus for sorting harvested potatoes from rock and other debris associated with harvested potatoes without damage to the potatoes.

It is yet another object of the present invention to provide apparatus for sorting potatoes from rock and similar debris, the apparatus comprising a water bath into which a mixture of potatoes and rock is discharged, the mixture being caused to move past a supporting baffle member, a stream of pressurized water being directed against the mixture to deflect the potatoes over and past the opening to a conveyor for removal of the potatoes from the water bath, the heavier rocks not being deflected sufficiently to prevent the rocks from falling through the opening to a second conveyor for separate discharge from the water bath.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
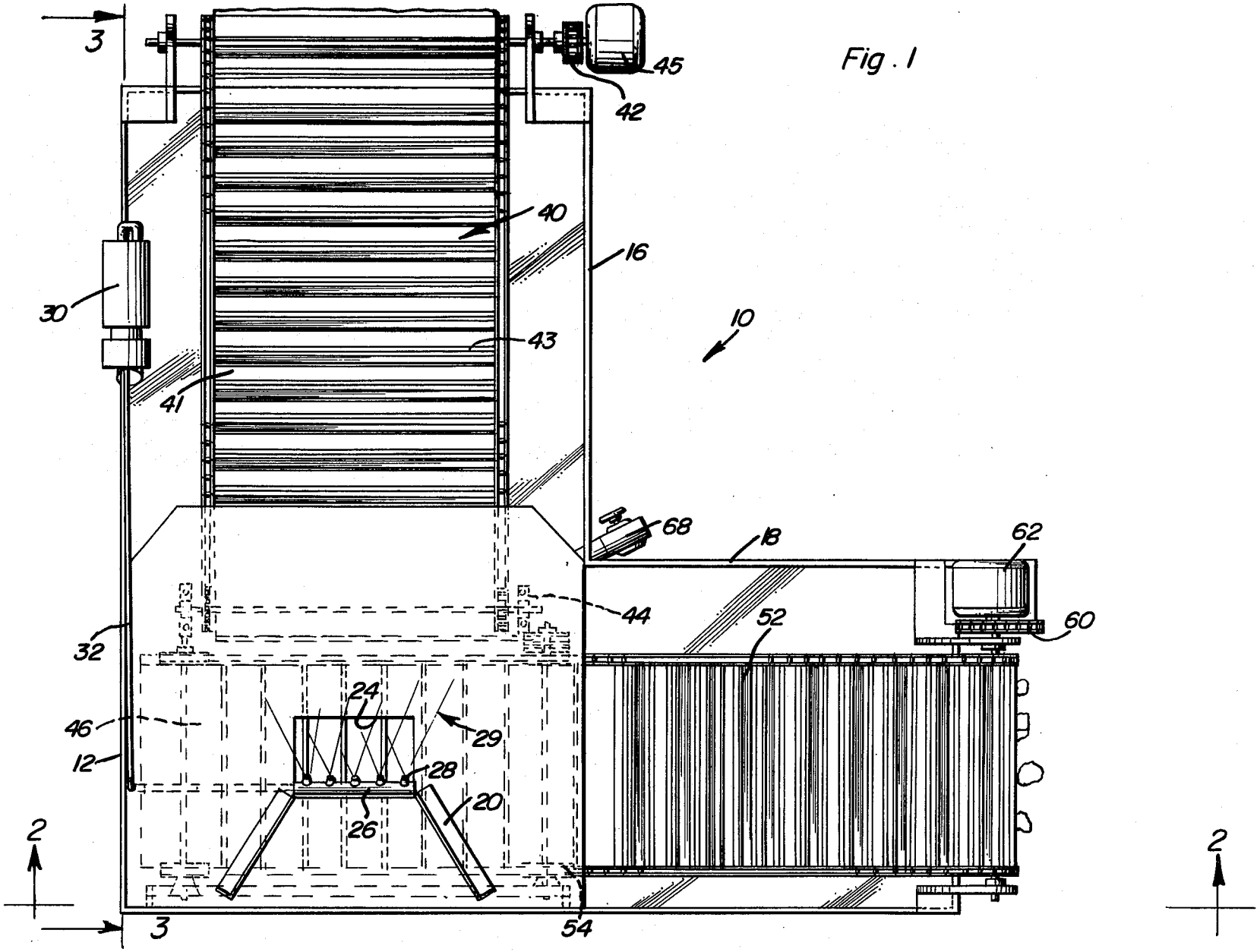
FIG. 1 is a plan view of the potato and rock sorting apparatus of the invention.

Referring now to the drawings, the present potato washing and sorting apparatus is seen generally at 10 to comprise an L-shaped water tank 12 which is conventionally supported on legs 14. The apparatus 10 is particularly intended to separate rock and similar material from potatoes as the mixed potato and rock are brought in from the field. The apparatus 10 can be efficiently utilized by set-up thereof in front of a known grading apparatus. As can particularly be seen in FIG. 1, the water tank 12 comprises a potato removal trough 16 and a rock removal trough 18 disposed substantially perpendicularly thereto. An inclined baffle member 22, which baffle member 22 substantially comprises a planar plate member, is disposed within the water tank 12 below the water level within said tank. The inclined baffle member 22 essentially extends toward the potato removal trough 16, the lowermost end 23 of the inclined baffle member being disposed in surmounting relation to lower end portions of a potato conveyor 40 which is located within the potato removal trough 16 and which will be described in detail hereinafter. As can be particularly seen in FIGS. 1 and 3, a mixture of potatoes, rock and associated debris is charged into the water tank 12 through a chute 20, the chute 20 having an opening at its lower end through which the mixture of potato and rock passes and is directed onto uppermost end 25 of the inclined baffle member 22. It is to be understood that reference to a mixture of potatoes and rock includes reference to components of a mixture, at least one component of which is of a low specific gravity relative to at least a second component thereof. Accordingly, the use of the term rock is intended to encompass debris and objects having a specific gravity greater than the specific gravity of the potatoes or other object from which rock or similar debris is to be separated.

Discharge of the mixture of potatoes and rock from the chute 20 onto the uppermost end 25 of the inclined baffle member 22 results in movement of the mixed rock and potatoes downwardly along the inclined baffle member 22, the water bath within which the mixture is now disposed retarding movement of the mixture due to the buoyant force exerted by the water on the components of the mixture. As the mixture of rock and potatoes moves downwardly along the inclined baffle member 22, the mixture is caused to move over an opening 24 disposed in the baffle member 22, the opening being of a dimension sufficient to allow the objects within the mixture to pass therethrough. A manifold device 26 having a plurality of nozzles 28 disposed therein is located along a forward leading edge 27 of the opening 24, the nozzles 28 being adapted to discharge a stream of water under pressure through the opening 24 from beneath said opening. The stream of water, which is seen generally at 29 is preferably directed through the opening 24 at an angle of substantially 45° to the plane in which the baffle member 22 lies. The stream of water is caused to exert a predetermined force against the components of the mixture of rock and potatoes sufficient to deflect the lighter potatoes upwardly over the opening 24, the force exerted by the stream of water being insufficient to deflect the rock. Accordingly, the rock component of the mixture falls under the influence of gravity through the opening 24 and downwardly within the water tank to be received on a rock conveyor 46 as will be described hereinafter.

Figure 3:
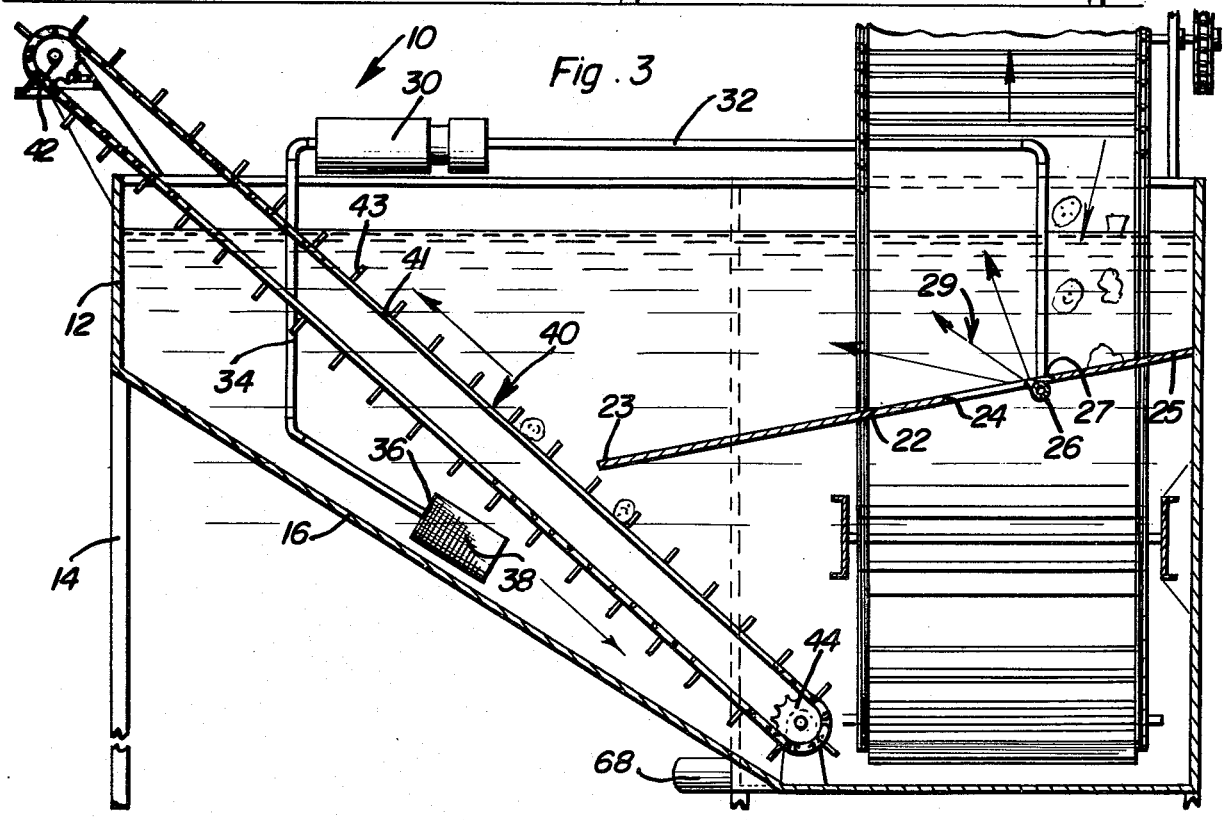
FIG. 3 is an elevational view in section taken generally along lines 3—3 of FIG. 1.

The stream of water 29 which exits the nozzles 28 of the manifold 26 is produced by a pump 30 which can be conveniently disposed on the water tank 12 as particularly shown in FIGS. 1 and 3. The pump 30 has a water supply line 32 extending to the manifold 26, water being received into the pump 30 from a water return line 34 which connects to a water inlet 36. The water inlet 36 is disposed beneath the water level within the water tank 12 and receives water thereinto for distribution to the pump 30. The water inlet 36 is provided with a screen 38 in a known fashion in order to prevent debris from entering the water inlet 36 and fouling the pump 30. Therefore, water within the water tank 12 is recirculated by the pump 30 through the manifold 26, a separate supply of water not being required to produce the stream of water 29 used to separate potatoes from rocks in the mixture loaded into the chute 20.

Figure 2:
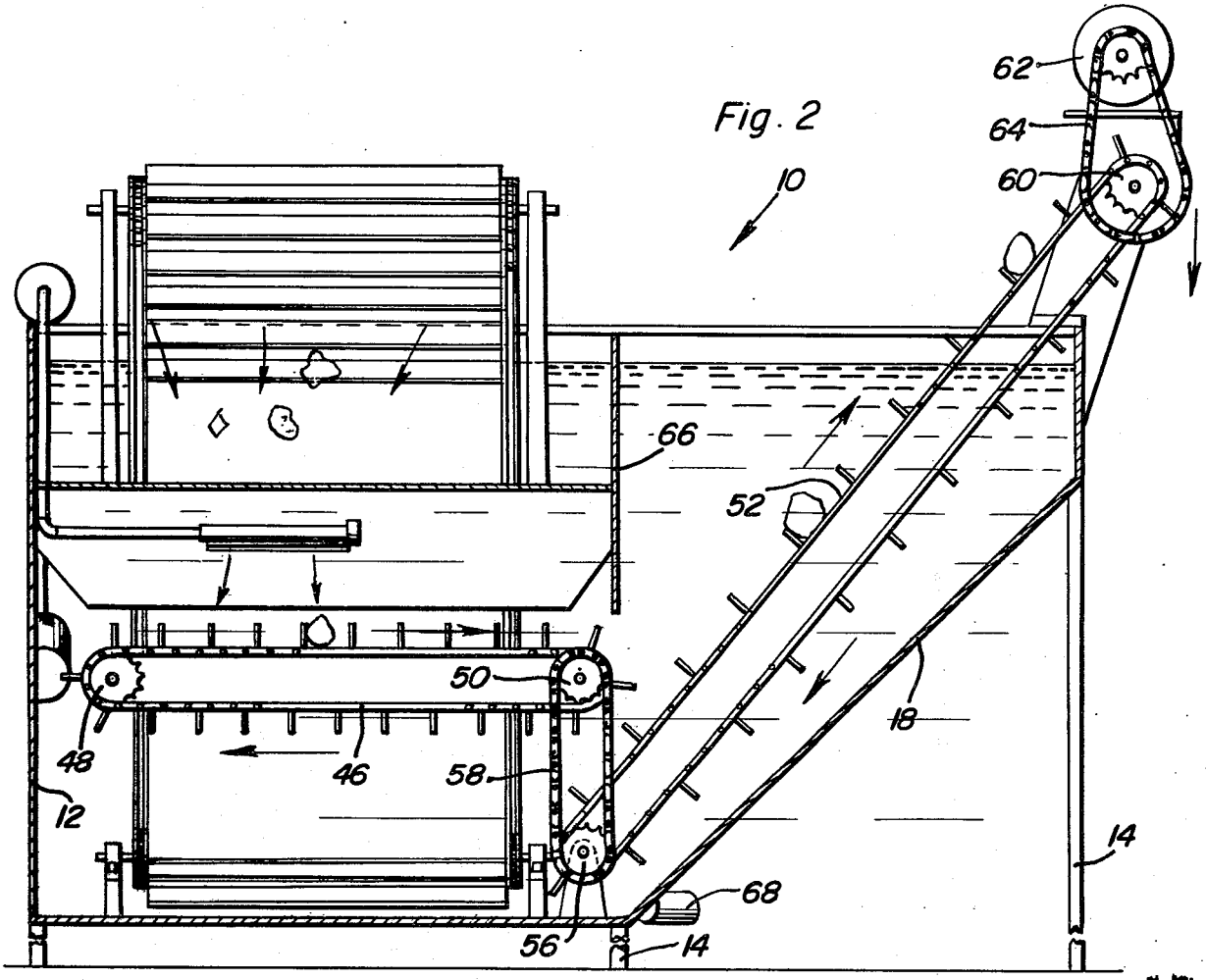
FIG. 2 is an elevational view in section taken generally along lines 2—2 of FIG. 1.

As can particularly be seen in FIG. 3, the potatoes in the mixure passing over the opening 24 in the inclined baffle member 22 are caused to be deflected upwardly over the opening 24, the potatoes then moving downwardly within the water tank 12 and into the potato removal trough 16. As can be seen in FIGS. 1 and 2, a divider gate 66 prevents movement of the potatoes into the rock removal trough 18. The potatoes move downwardly along the inclined baffle member 22 and are engaged by the potato conveyor 40, the potato conveyor 40 being comprised of an endless belt 41 having L-shaped lands 43 disposed thereon. The potatoes are thereby engaged in a known manner by the L-shaped lands 43 and moved upwardly on the conveyor 40 and out of the water tank 12. The potatoes exiting the water tank 12 have thus been separated from rocks and similar debris and have also been washed within the water which fills the water tank 12. The potatoes are discharged from the conveyor 40 at the upper portion thereof, the potatoes being collected within mobile bins or other devices (not shown) for transport, grading, or subjection to other operations. The potato conveyor 40 is particularly seen to conventionally comprise a drive gear and pulley 42 which is directly driven by a motor 45, an idler gear and pulley 44 being disposed at the opposite end of the conveyor 40 within the water tank 12.

Referring now to FIGS. 1 and 2, it can be seen that the rocks falling through the opening 24 in the inclined baffle member 22 are deposited on the rock conveyor 46 as aforesaid, the rock conveyor 46 being disposed within the water tank 12 beneath the opening 24 in the inclined baffle member 22 and substantially at the confluence of the potato removel troughs 16 and the rock removal trough 18. The rock conveyor 46 is disposed substantially horizontally within the water tank 12 and comprises an endless belt which moves about idler pulleys 48. A gear 50 disposed on the idler pulley 48 nearmost the rock removal trough 18 is mechanically connected to a rock elevator 52 which extends upwardly within the rock removal trough 18 for removal of rocks from the water tank 12. The lowermost end of the rock elevator 52 has an idler pulley 54 carrying the endless belt which comprises said rock elevator 52, a gear 56 being carried by the idler pulley 54 and connecting to the gear 50 by means of a gear chain 58. The uppermost end of the rock elevator 52 has a drive gear and pulley 60 which is directly driven by motor 62, the endless belt comprising the rock elevator 52 moving about the idler pulley 54 and drive gear and pulley 60 in a known manner. The rock conveyor 46 and the rock elevator 54 can further be provided with L-shaped lands in a known manner such that the rocks can be more efficiently carried from the water tank 12. As can particularly be seen in FIG. 2, the rocks deposited on the substantially horizontal rock conveyor 46 are discharged from said rock conveyor 46 onto the lowermost end of the rock elevator 52, the rock elevator 52 moving in a clockwise direction to elevate the rocks engaged thereon upwardly of the water tank 12, the rocks being discharged from the rock elevator 52 at the uppermost end thereof. The motor 62 is seen to drive the rock elevator 52 through a drive chain 64.

Potatoes are therefore separated from rocks in the mixture loaded into the sorting apparatus 10, the potatoes being directed along the potato conveyor 40 substantially at right angles to the rocks which fall through the opening 24 in the inclined baffle member 22 and are directed out of the water tank 12 along the rock conveyor 46 and the rock elevator 52. Sediment, sand and other debris can be removed from the sorting apparatus 10 by periodically draining the water tank 12 through the drain 68. While the stream of water 29 which exits the manifold 26 through the nozzles 28 is preferably directed through the opening 24 at an angle of 45° to the inclined baffle member 22, it is to be understood that the stream of water can be directed against the potatoes and rocks at angles other than 45°, the choice of a 45° angle being particularly expeditious in the practice of the invention. The manifold 26 can be seen to be conveniently formed of a length of pipe, such as 1¼ inch pipe, the length of pipe having 3/32 inch holes formed therein, such holes being adequate for use with the invention to function as the nozzles 28. A pressure of 30 to 60 pounds is typically adequate to cause deflection of the potatoes from the mixture and to allow the rock to fall through the opening 24 in the inclined baffle member 22.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for separating heavier components from lighter components mixed therewith comprising:

container means having a liquid disposed therein, said liquid having a surface disposed at a predetermined height within said container means;

mixed component delivery means having a discharge end spaced above said liquid surface for depositing mixed components into said liquid;

baffle means disposed below said liquid surface, said baffle means having a receiving end disposed vertically below said discharge end for receiving said mixed components after they have been deposited by said delivery means and fallen through said liquid, said baffle means being substantially planar and being positioned within said container means inclining downwardly from said receiving end to a lower end, the mixed components moving downwardly along said baffle means incline;

an aperture formed in said baffle means and spaced from said receiving end along said incline for allowing the heavier mixed components to fall therethrough under the influence of gravity after having moved downwardly from said receiving end;

nozzle means disposed below said aperture for causing an upward flow of liquid through said aperture to deflect the lighter components away from said aperture thereby allowing only the heavier components to fall through said aperture;

pump means connected to said nozzle means for providing a continuous pressurized supply of liquid to said nozzle means;

first conveyor means having one end thereof disposed vertically below said aperture for receiving said heavier components and removing them from the body of liquid; and second conveyor means having one end thereof disposed vertically below said lower end of said baffle means for receiving said lighter components and removing them from said liquid.

2. The apparatus of claim 1 wherein said nozzle means comprises a plurality of spaced nozzle members disposed along the uppermost edge of said aperture for directing said flow of liquid upwardly against said mixed components.

3. The apparatus of claim 2 wherein said pump means comprises a pump with a supply pipe joining the pump to the nozzle members, and means for taking in liquid from said body of liquid and supplying said liquid to said pump, and a screen disposed over said means for taking in liquid.

* * * * *